US010672335B2

(12) United States Patent
Xiang

(10) Patent No.: US 10,672,335 B2
(45) Date of Patent: Jun. 2, 2020

(54) DISPLAY PANEL DRIVING METHOD AND DISPLAY PANEL

(71) Applicant: KUNSHAN GO-VISIONOX OPTO-ELECTRONICS CO., LTD., Jiangsu (CN)

(72) Inventor: Dong Xiang, Jiangsu (CN)

(73) Assignee: KUNSHAN GO-VISIONOX OPTO-ELECTRONICS CO., LTD., Jiangsu (CN)

( * ) Notice: Subject to any disclaimer, the term of this patent is extended or adjusted under 35 U.S.C. 154(b) by 0 days.

(21) Appl. No.: 16/318,550

(22) PCT Filed: Feb. 11, 2018

(86) PCT No.: PCT/CN2018/076208
§ 371 (c)(1),
(2) Date: Jan. 17, 2019

(87) PCT Pub. No.: WO2018/153290
PCT Pub. Date: Aug. 30, 2018

(65) Prior Publication Data

US 2019/0228704 A1 Jul. 25, 2019

(30) Foreign Application Priority Data

Feb. 4, 2017 (CN) ..... 2017 1 0101543

(51) Int. Cl.
*G09G 3/3225* (2016.01)

(52) U.S. Cl.
CPC ... *G09G 3/3225* (2013.01); *G09G 2310/0297* (2013.01); *G09G 2320/0233* (2013.01); *G09G 2320/0626* (2013.01)

(58) Field of Classification Search
CPC ..... G09G 3/3225; G09G 3/32
See application file for complete search history.

(56) References Cited

U.S. PATENT DOCUMENTS

| | | | | |
|---|---|---|---|---|
| 6,847,172 | B2 | 1/2005 | Suzuki | |
| 10,163,392 | B2 * | 12/2018 | Imai | G09G 3/3225 |
| 2002/0105492 | A1 | 8/2002 | Kosaka | |

(Continued)

FOREIGN PATENT DOCUMENTS

| | | | |
|---|---|---|---|
| CN | 1698086 | A | 11/2005 |
| CN | 1011919125 | A | 6/2008 |
| CN | 101216645 | A | 7/2008 |

(Continued)

*Primary Examiner* — Alexander Eisen
*Assistant Examiner* — Cory A Almeida
(74) *Attorney, Agent, or Firm* — Muncy, Geissler, Olds & Lowe, P.C.

(57) ABSTRACT

A method for driving a display panel includes controlling a signal of ON/OFF state of a switch in a Demux circuit as a switch signal, and dividing each rising time period in the switch signal into two phases (T, T1), so that the abrupt change effect of voltage generated on both side positions of the display panel and a middle position of the display panel is relatively uniform, ensuring that the charging effect of the display panel at different positions is substantially the same, the brightness of the display panel is even after being driven, and the problem of bright lines in the column direction of the display panel is effectively improved.

9 Claims, 3 Drawing Sheets

(56) References Cited

U.S. PATENT DOCUMENTS

2006/0279512 A1 12/2006 Kim et al.

FOREIGN PATENT DOCUMENTS

| | | | |
|---|---|---|---|
| CN | 101950536 | A | 1/2011 |
| CN | 103903574 | A | 7/2014 |
| CN | 104347030 | A | 2/2015 |
| CN | 104715714 | A | 6/2015 |
| JP | 20090129558 | A | 12/2009 |
| JP | 2011154086 | | 8/2011 |
| TW | 201005712 | A | 2/2010 |
| WO | WO2016163299 | A1 | 10/2016 |

* cited by examiner

DISPLAY PANEL DRIVING METHOD AND DISPLAY PANEL

TECHNICAL FIELD

The present invention relates to the field of flat panel display technologies, and in particular, to a display panel driving method and a display panel.

BACKGROUND

A small sized display panel, for example an active-matrix organic light emitting diode (AMOLED) display panel, has the advantages of a wide viewing angle, a high contrast, a low power consumption, being light and thin, and so on. At present, the AMOLED is widely applied to fields such as smart watches or smart wear.

Due to the small size and high resolution requirement of the AMOLED display panels when applied to smart wear, a Demux circuit is needed in terms of design. Usually, switch signals in the Demux circuit are transmitted from two side positions to the middle position. Moreover, wiring of the display panel is limited by factors such as shape and size. Consequently, the width of the wiring becomes smaller, resulting in the phenomenon of uneven brightness at the two side positions and the middle position, which is manifested as the occurrence of S-direction (i.e. a column direction) mura at the middle position. Therefore, the yield of products is affected.

Those skilled in the art keep seeking for a solution to solve the problem of uneven brightness generated after driving a display panel having a Demux circuit.

SUMMARY

It is an object of the present invention to provide a display panel driving method to solve the problem of uneven brightness generated after driving a display panel having a Demux circuit.

To solve the foregoing technical problem, the present invention provides a method for driving a display panel having a Demux circuit, comprising:

setting a signal for controlling an on/off state of a switch in the Demux circuit as a switch signal; and dividing each rise time period of the switch signal into two phases, wherein the switch in the Demux circuit keeps an on state in the rise time period of the switch signal.

Optionally, in the method for driving a display panel, the two phases comprise a first phase in which the switch signal transforms from a low electrical level to a predetermined electrical level and a second phase, wherein the predetermined electrical level is an electrical level between the low electrical level and a high electrical level, and the switch keeps the on state when the switch signal is at the predetermined electrical level.

Optionally, in the method for driving a display panel, the switch signal transforms from the predetermined electrical level to the high electrical level in the second phase.

Optionally, in the method for driving a display panel, the switch is in the on state when the switch signal is at the low level.

Optionally, in the method for driving a display panel, the switch is in an off state when the switch signal is at the high level.

Optionally, in the method for driving a display panel, the switch is a thin film transistor.

The present invention further provides a display panel, including a driving module, a Demux circuit module connected to the driving module, and a pixel circuit module connected to the Demux circuit module, wherein the driving module outputs a switch signal for controlling an on/off state of a switch in the Demux circuit module to the Demux circuit module, wherein each rise time period is divided into two phases, during which the switch signal rises, and the switch in the Demux circuit module keeps an on state in the rise time period of the switch signal.

Optionally, in the display panel, the Demux circuit module includes a number of Demux circuits, each Demux circuit comprising a switch, a parasitic capacitor, and a coupling capacitor, wherein a first polar plate of the parasitic capacitor is connected to the switch, and a second polar plate of the parasitic capacitor is connected to a first polar plate of the coupling capacitor.

Optionally, in the display panel, the pixel circuit module comprises a number of pixel circuits, the number of the pixel circuits being same to the number of the Demux circuits. Each pixel circuit is connected to a corresponding Demux circuit at a second polar plate of the coupling capacitor.

At the end of the first phase, the switch signal transforms from the low electrical level to the predetermined electrical level to generate a feedthrough voltage, $$\Delta V_a = (V_x - VGL) * \frac{C1}{C1 + C2},$$

$V_x$ representing the predetermined electrical level, VGL representing the low electrical level, C1 representing a parasitic capacitor, C2 representing a coupling capacitor.

$\Delta V_a$ releases a plurality of charges through a switch transistor, resulting in a voltage written into a plurality of pixel circuits on two sides of the display panel being Vdata+$\Delta$V1', $\Delta$V1' being smaller than $\Delta V_a$.

In the display panel driving method and the display panel provided in the present invention, setting the signal for controlling the on/off state of the switch in the Demux circuit as a switch signal, and dividing each rise time period of the switch signal into two phases, enable the voltage jump effects generated at two side positions of the display panel and the middle position of the display panel becomes relatively uniform, thereby ensuring approximately same charging effects at different positions of the display panel and even brightness of the driven display panel, and effectively alleviating the problem of the occurrence of the mura in a column direction of the display panel.

DETAILED DESCRIPTION OF EMBODIMENTS

The method for driving a display panel provided in the present invention will be described in more detail below with reference to the accompanying drawings and specific embodiments. The advantages and features of the present invention will be more comprehensible according to the following descriptions and claims. It is noted that the accompanying drawings are presented in a simplified form not necessarily presented to scale, with the only intention to facilitate convenience and clarity in explaining the object of the present invention.

Figure 1:
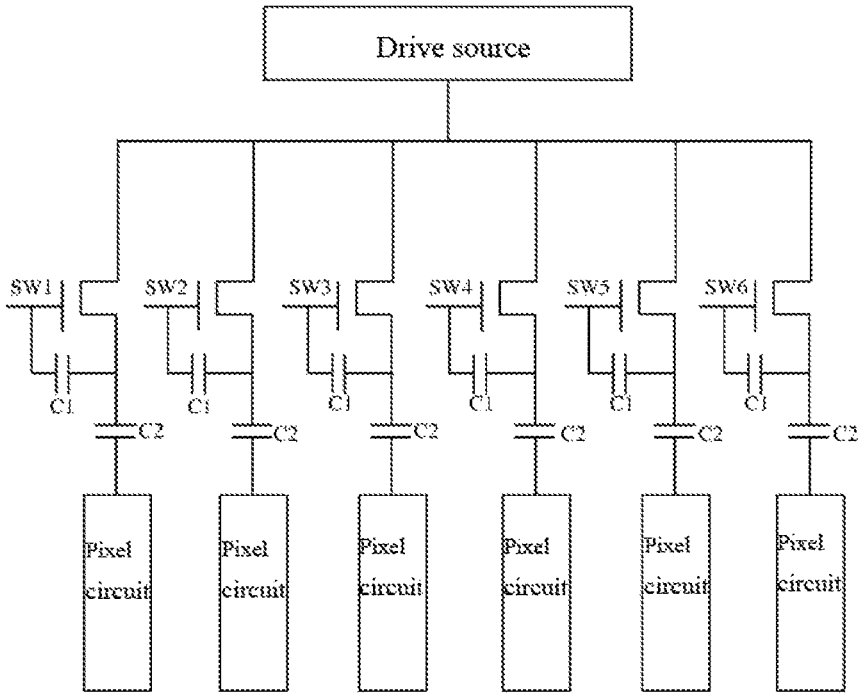
FIG. 1 is a structural schematic diagram of a display panel having a Demux circuit.

Referring to FIG. 1, a structural schematic diagram of a display panel having a Demux circuit. As shown in FIG. 1, the display panel includes a drive source, a number of Demux circuits and a number of pixel circuits. The number of the Demux circuits is the same as the number of the pixel circuits. The drive source is connected to each of the Demux circuits with each Demux circuit connecting to a corresponding pixel circuit. Each Demux circuit includes a switch (SW1, SW2, SW3, SW4, SW5, or SW6), a parasitic capacitor C1, and a coupling capacitor C2. The parasitic capacitor C1 is disposed between the switch and the coupling capacitor C2, and the coupling capacitor C2 is disposed between the parasitic capacitor C1 and the pixel circuit.

Figure 2:
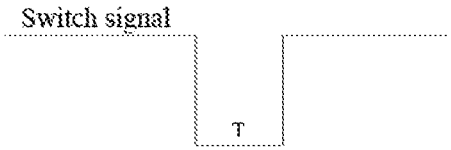
FIG. 2 is a timing sequence diagram of a switch signal in the prior art.

With reference to the content of FIG. 1 and FIG. 2, the existing method for driving a display panel uses a switch signal having a timing sequence as shown in FIG. 2 for driving. The on/off state of a switch is controlled by the switch signal, wherein the switch (for example, a thin film transistor (TFT)) is off when the switch signal is at a high electrical level VGH, and the switch is on when the switch signal is at a low electrical level VGL. When the switch signal transforms from the low electrical level VGL to the high electrical level VGH after a time period T, a feedthrough effect (i.e. voltage jump) raises the voltage on one end of the parasitic capacitor C1. It could be learned from the formula Q=CU that the raised voltage is $$\Delta V = (VGH - VGL) * \frac{C1}{C1 + C2},$$

which is also referred to as the feedthrough voltage. Under the coupling action of the parasitic capacitor C1, the quantity of charges on the polar plates of the coupling capacitor C2 is increased, so that the voltage Vdata written into a pixel circuit from the drive source is increased. In this case, the voltage stored into the coupling capacitor C2 becomes Vdata+ΔV.

Figure 3:
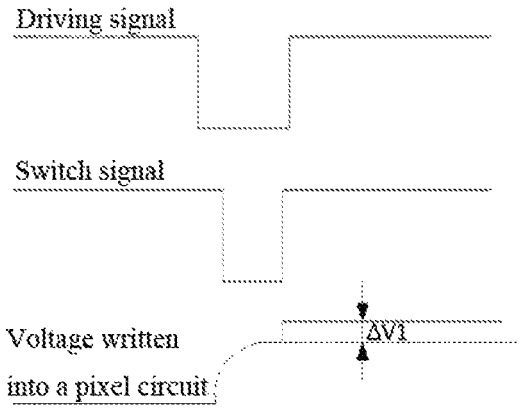
FIG. 3 is a schematic diagram of a driving signal, a switch signal, and a variation of the voltage written into a pixel circuit at two side positions of a display panel in the prior art.
Figure 4:
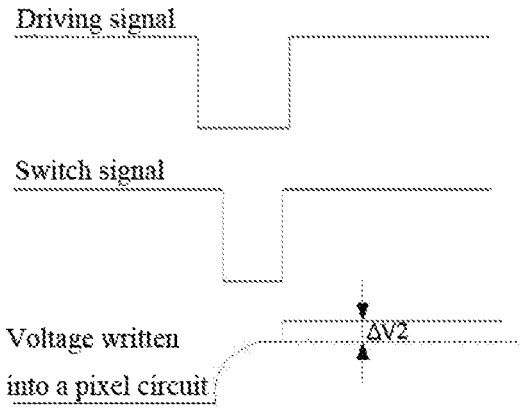
FIG. 4 is a schematic diagram of a driving signal, a switch signal, and a variation of the voltage written into a pixel circuit at the middle position of a display panel in the prior art.

The reason why the S-direction mura appears at the middle position of a display panel having a Demux circuit is as follows: The switch signal is a two-end driving signal (that is, being driven from two sides of the display panel to the middle of the display panel), As shown in FIG. 4. The switch signal at the middle position of the display panel, affected by impedance, suffers from a delay when rising from the low electrical level to the high electrical level. The feedthrough voltage ΔV generated at this moment is partially released through the switch (for example, a TFT). Therefore, compared with the voltage Vdata+ΔV1 (as shown in FIG. 3) written into the pixel circuit from two side positions (that is, side positions adjacent to the middle position), the voltage Vdata+ΔV2 (as shown in FIG. 4) written into the pixel circuit from the middle position becomes lower, that is, ΔV2 is lower than ΔV'. In this case, the S-direction mura appears at the middle position of the display panel. Herein, ΔV' and ΔV2 refer to feedthrough voltages respectively at two side positions of the display and at the middle position of the display, and the value of ΔV' is greater than that of ΔV2.

Figure 5:
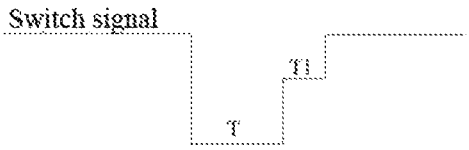
FIG. 5 is a timing sequence diagram of a switch signal in an embodiment of the present invention.

Based on the foregoing research result on the appearance of S-direction mura at the middle position of a display panel having a Demux circuit, referring to FIG. 5, the present application provides a novel method for driving a display panel, specifically comprising:

setting a signal for controlling an on/off state of a switch in the Demux circuit as a switch signal, and dividing each rise time period of the switch signal into two phases, wherein the switch in the Demux circuit keeps the on state in the rise time period of the switch signal. Herein, the rise time period of the switch signal is a time period that the switch signal transforms from a high electrical level to a low electrical level and again transforms to the high electrical level. The two phases include a first phase and a second phase. When the first phase T ends, the switch signal transforms from a low electrical level to a predetermined electrical level, and the predetermined level is an electrical level between the low electrical level and the high electrical level. Moreover, when the switch signal is at the predetermined electrical level, the switch keeps the on state. When the second phase T1 ends, the switch signal transforms from the predetermined electrical level to the high electrical level. The first phase T and the second phase T1 together form the rise time period.

The problem of the S-direction mura appearing at the middle position of a display panel having a Demux circuit is mainly solved through changing timing sequence of the switch signal. Specifically, the switch signal shown in FIG. 5 is used to replace the switch signal shown in FIG. 2 to control the driving operation.

Figure 6:
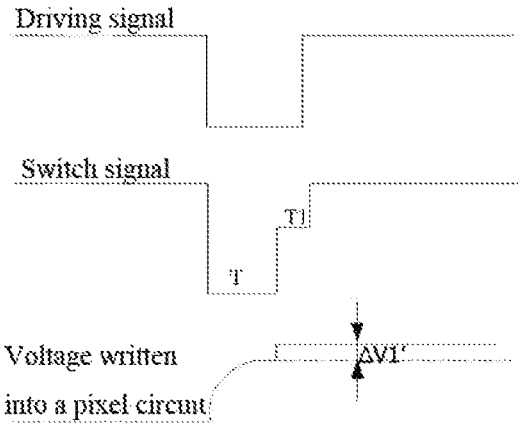
FIG. 6 is a schematic diagram of a driving signal, a switch signal, and a variation of the voltage written into a pixel circuit at two side positions of a display panel in an embodiment of the present invention.
Figure 7:
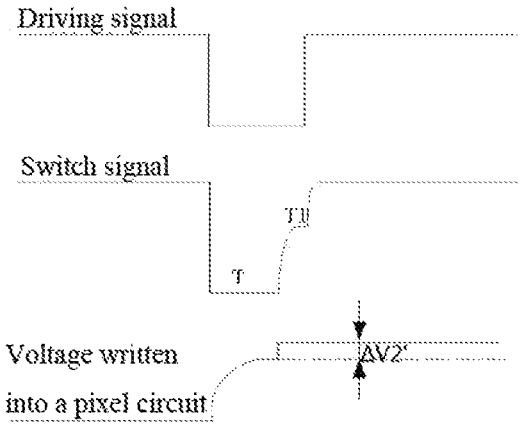
FIG. 7 is a schematic diagram of a driving signal, a switch signal, and a variation of the voltage written into a pixel circuit at a middle position of a display panel in an embodiment of the present invention.

Referring to FIG. 6 and FIG. 7, the specific process is as follows:

At the end of the first phase T, the switch signal transforms from a low electrical level VGL to a predetermined electrical level V, (corresponding to the first phase), generating a feedthrough voltage $$\Delta V_a = (V_x - VGL) * \frac{C1}{C1 + C2}.$$

Specifically, as shown in FIG. 6, at two side positions of the display and in the second phase T1, the switch signal is at the predetermined electrical level V, and the switch keeps the on state. A feedthrough voltage $\Delta V_a$ is generated by transforming the level VGL corresponding to the first phase T into the electrical level V, corresponding to the second phase T1. Some charges of $\Delta V_a$ may be released through a switch transistor, resulting in the voltage written into pixel circuits on two sides of the display panel being Vdata+ΔV1', where ΔV1' is slightly lower than $\Delta V_a$.

As shown in FIG. 7, at the middle position of the display and in the second phase T1, the switch signal is at the predetermined electrical level V, and the switch keeps the on state. A feedthrough voltage $\Delta V_b$ is generated by transforming the electrical level VGL corresponding to the first phase T into the electrical level V, corresponding to the second phase T1. Some charges of $\Delta V_b$ may be released through a switch transistor, resulting in the voltage written into a pixel circuit at the middle position of the display panel being Vdata+ΔV2', where ΔV2' is slightly lower than $\Delta V_b$.

It can be learned from the foregoing analysis that although the feedthrough voltage $\Delta V_b$ at the middle position of the display is still lower than the feedthrough voltage ΔVa at the two side positions of the display, due to the value of ($V_x$−VGL) being smaller than that of (VGH−VGL), the feedthrough effects at the two side positions and the middle position of the display panel are relatively even, that is, there is a little difference between the value of ΔVa and the value of $\Delta V_b$. Therefore, the voltage Vdata+ΔV2' (as shown in FIG. 7) written into the pixel circuit from the middle position is almost equal to the voltage Vdata+ΔV1' written into the pixel circuit from side positions (that is, side positions adjacent to the middle position), thus no S-direction mura would appear at the middle position of the display panel.

Figure 8:
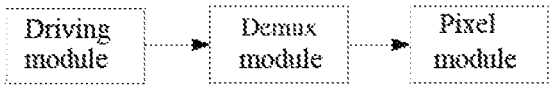
FIG. 8 is a structural schematic diagram of a display panel in an embodiment of the present invention.

Referring to FIG. 8, the present invention further provides a display panel. The display panel includes a driving module or called a driving circuit, a Demux module or called a Demux circuit module connected to the driving module, and a pixel module or called a pixel circuit module connected to the Demux module. The driving module outputs a switch signal for controlling an on/off state of a switch in the Demux module to the Demux module. Each rise time period of the switch signal is divided into two phases, during which the switch signal rise, and the switch in the Demux module keeps the on state in the rise time period of the switch signal.

The Demux module includes a number of Demux circuits, each Demux circuit including a switch, a parasitic capacitor, and a coupling capacitor, wherein a first polar plate of the parasitic capacitor is connected to the switch, and a second polar plate of the parasitic capacitor is connected to a first polar plate of the coupling capacitor.

The pixel module includes a number of pixel circuits with the number of the pixel circuits being the same as the number of the Demux circuits, wherein each pixel circuit is connected to a corresponding Demux circuit at a second polar plate of a coupling capacitor of the corresponding Demux circuit.

In conclusion, the display panel driving method and the display panel provided in the present invention, setting a signal for controlling the on/off state of the switch in the Demux circuit as a switch signal, and dividing each rise time period of the switch signal into two phases enable the voltage jump effects generated at two side positions of the display panel and a middle position of the display panel becoming relatively uniform, thereby ensuring approximately same charging effects at different positions of the display panel and even brightness of the driven display panel and effectively alleviating the problem of the occurrence of the mura in a column direction of the display panel.

The foregoing descriptions are merely descriptions of the preferred embodiments of the present invention rather than any limitations to the scope of the present invention. Any changes or modifications made by a person of ordinary skilled in the art according to the foregoing disclosure fall within the protection scope of the claims.

What is claimed is:

1. A method for driving a display panel having a Demux circuit, comprising:

setting a switch signal for controlling an on/off state of a switch in the Demux circuit; and dividing each rise time period of the switch signal into two phases, wherein the switch in the Demux circuit keeps an on state in the rise time period of the switch signal, wherein the two phases comprise a first phase and a second phase, wherein the Demux circuit module comprises a number of Demux circuits, each Demux circuit comprising a switch, a parasitic capacitor, and a coupling capacitor, and wherein a first polar plate of the parasitic capacitor is connected to the switch, and a second polar plate of the parasitic capacitor is connected to a first polar plate of the coupling capacitor, and wherein at an end of the first phase of each rise time period, the switch signal transforms from a low electrical level to a predetermined electrical level between the low electrical level and a high electrical level to generate a feedthrough voltage, $$\Delta V_a = (V_x - VGL) * \frac{C1}{C1 + C2},$$

$V_x$ representing the predetermined electrical level, VGL representing the low electrical level, C1 representing a parasitic capacitor, C2 representing a coupling capacitor.

2. The method for driving a display panel according to claim 1, wherein and the switch keeps the on state when the switch signal is at the predetermined electrical level.

3. The method for driving a display panel according to claim 2, wherein the switch signal transforms from the predetermined electrical level to the high electrical level in the second phase.

4. The method for driving a display panel according to claim 1, wherein the switch keeps the on state when the switch signal is at the low electrical level.

5. The method for driving a display panel according to claim 1, wherein the switch keeps the off state when the switch signal is at the high electrical level.

6. The method for driving a display panel according to claim 1, wherein the switch is a thin film transistor.

7. A display panel, comprising a driving circuit, a Demux circuit module connected to the driving circuit, and a pixel circuit module connected to the Demux circuit module, wherein the driving circuit outputs a switch signal for controlling an on/off state of a switch in the Demux circuit module to the Demux circuit module, wherein each rise time period is divided into two phases comprising a first phase and a second phase, and at an end of the first phase of each rise time period, the switch signal transforms from a low electrical level to a predetermined electrical level between the low electrical level and a high electrical level to generate a feedthrough voltage, $$\Delta V_a = (V_x - VGL) * \frac{C1}{C1 + C2},$$

Vx representing the predetermined electrical level, VGL representing the low electrical level, C1 representing a parasitic capacitor, C2 representing a coupling capacitor, wherein the switch in the Demux circuit is kept in an on state in the rise time period of the switch signal, wherein the Demux circuit module comprises a number of Demux circuits, each Demux circuit comprising a switch, a parasitic capacitor, and a coupling capacitor, and wherein a first polar plate of the parasitic capacitor is connected to the switch, and a second polar plate of the parasitic capacitor is connected to a first polar plate of the coupling capacitor.

8. The display panel according to claim 7, wherein the pixel circuit module comprises a number of pixel circuits, the number of the pixel circuits being same to the number of the Demux circuits, and each pixel circuit is connected to a corresponding Demux circuit at a second polar plate of a coupling capacitor of the corresponding Demux circuit.

9. The method for driving a display panel according to claim 1, wherein $\Delta V_a$ releases a plurality of charges through a switch transistor, resulting in a voltage written into a plurality of pixel circuits on two sides of the display panel being Vdata+$\Delta$V1', $\Delta$V1' being smaller than $\Delta V_a$.

* * * * *